US005911600A

United States Patent [19]

Mosquera

[11] Patent Number: 5,911,600

[45] Date of Patent: Jun. 15, 1999

[54] THREE PORT CONNECTOR

[75] Inventor: Rene Augusto Mosquera, Laguna Niguel, Calif.

[73] Assignee: ITT Manufacturing Enterprises, Inc., Wilmington, Del.

[21] Appl. No.: 08/900,558

[22] Filed: Jul. 25, 1997

[51] Int. Cl.[6] ..... H01R 25/00

[52] U.S. Cl. ..... 439/655

[58] Field of Search ..... 439/638, 650, 439/655, 651, 652

[56] References Cited

U.S. PATENT DOCUMENTS

| | | | |
|---|---|---|---|
| 540,540 | 6/1895 | Croskey et al. . | |
| 1,568,156 | 1/1926 | Herskovitz . | |
| 1,941,488 | 1/1934 | Propp | 173/334 |
| 3,005,179 | 10/1961 | Holt | 339/159 |
| 4,085,996 | 4/1978 | Koslo | 339/159 |
| 4,313,646 | 2/1982 | Millhimes et al. | 339/156 |
| 4,415,217 | 11/1983 | Clabburn et al. | 339/113 |
| 4,571,018 | 2/1986 | Annoot | 339/60 |
| 5,190,481 | 3/1993 | Ju | 439/654 |
| 5,242,319 | 9/1993 | Ju | 439/752 |

*Primary Examiner*—Neil Abrams
*Assistant Examiner*—J. F. Duverne
*Attorney, Agent, or Firm*—Thomas L. Peterson

[57] ABSTRACT

A connector has three connection ports (12A, 12B, 12C) lying in a horizontal port plane (30), with a set of terminals (32) at each port, wherein each set of terminals includes a pair of terminals (41A, 42A) lying in a horizontal row plane (50), which includes sheet metal multi conductors (51–54) that form and connect together one corresponding terminal at each of the ports. Each sheet metal multi conductor forms a corresponding terminal at each port that all lie on the row plane, a middle (60) that lies in a horizontal offset plane (66) that is spaced from the row plane, and ends (62) with inclined parts (64) that extend between the row plane and the offset plane. The first and second terminals at each port are connected by identical multi conductors, where one is turned upside-down from the orientation of the other.

10 Claims, 4 Drawing Sheets

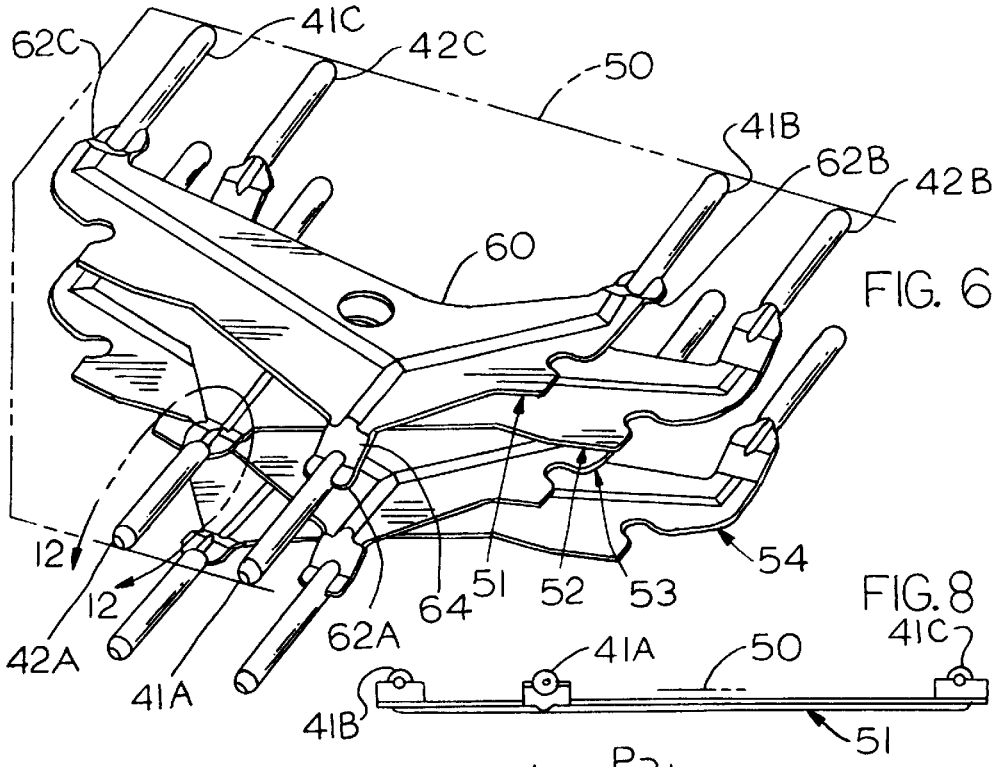
FIG. 6
FIG. 8
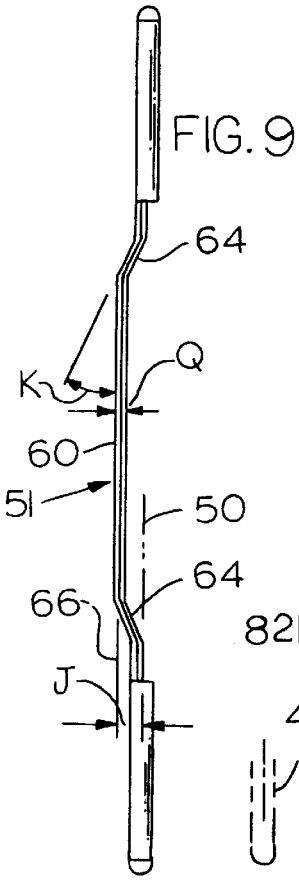
FIG. 9
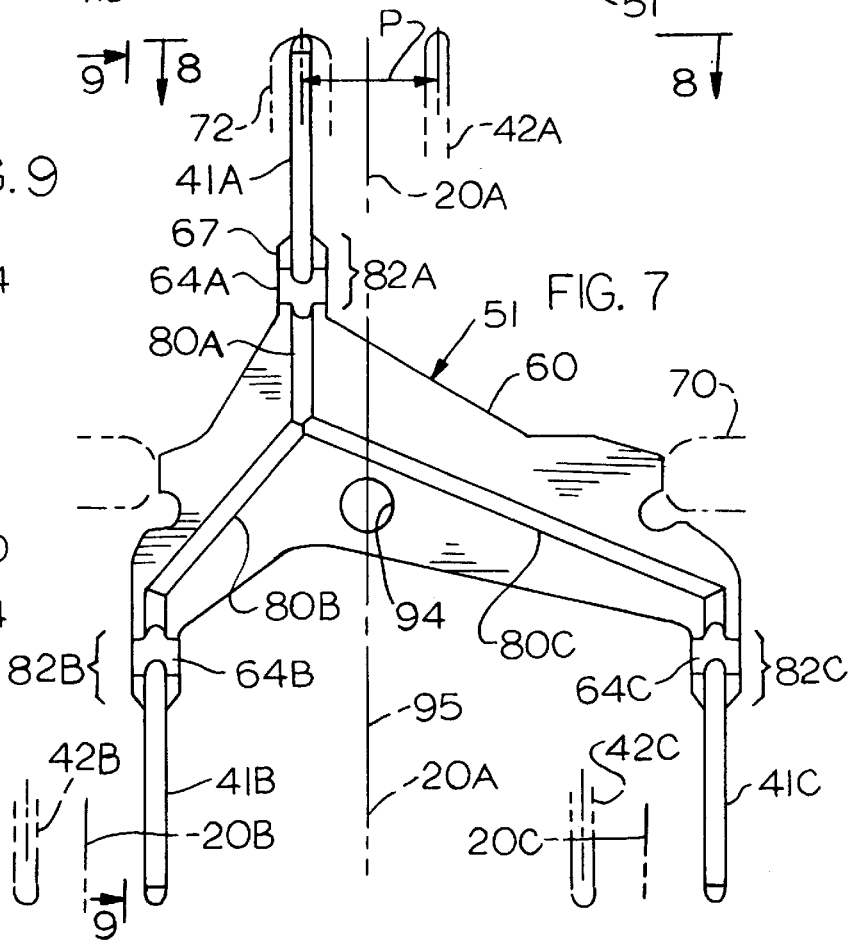
FIG. 7

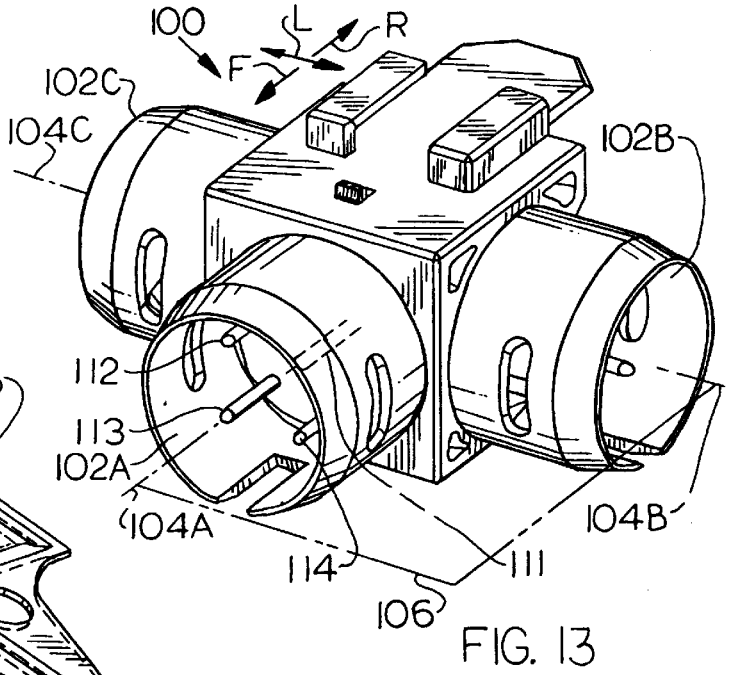
FIG. 13
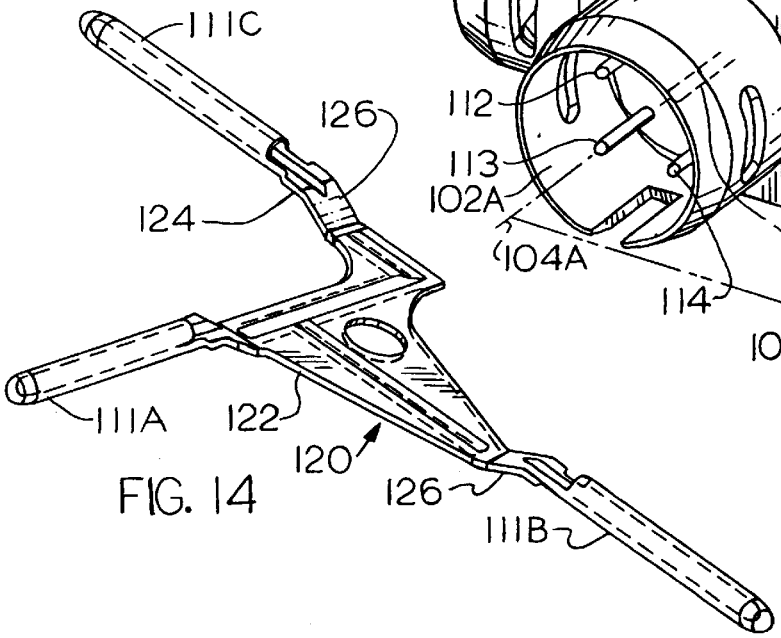
FIG. 14
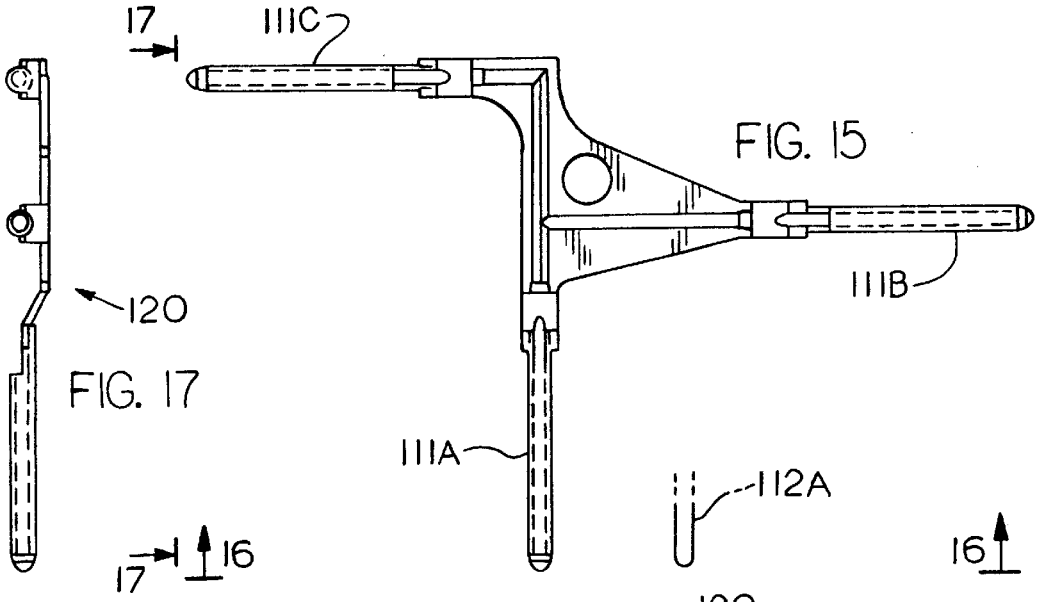
FIG. 15
FIG. 17
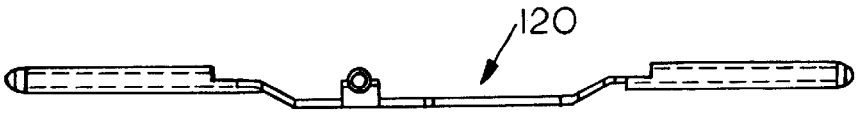
FIG. 16

THREE PORT CONNECTOR

BACKGROUND OF THE INVENTION

Electrical connectors with a plurality of ports, which are sometimes referred to as headers, are used to connect plugs (or sockets) at the ends of two or more different cables. U.S. Pat. No. 5,639,255 shows an electrical connector with two ports, that can be mounted on a pressure-tight wall such as an outer wall of a vehicle transmission. There are some applications where electrical connectors of this type are required that have three (or even four) ports, with a set a contacts at each port and with each contact at a port connected to the other corresponding contacts at the other ports.

It can be difficult to provide multi conductors that each connects three terminals at the three ports, without interference (engagement) of one multi conductor with another. U.S. Pat. No. 4,415,217 describes an arrangement wherein the axes of three or four different ports all lie on a common horizontal plane, with one terminal at each port connected to a corresponding terminal at each of the other ports. This is accomplished by staggering the contacts so no two contacts at a port lie in a horizontal row. Customers who purchase such connectors often wish to receive connectors where there are horizontal rows of terminals in connectors that have ports lying on a horizontal plane. Although such interconnection can be made by wires, low cost manufacture and ruggedness require that the multi conductors be constructed of sheet metal. A connector with at least three ports lying on a horizontal plane, with at least one horizontal row of two terminals at each port, which had sheet metal multi conductors for connecting a terminal at each of the ports, would be of value.

SUMMARY OF THE INVENTION

In accordance with one embodiment of the present invention, a connector is provided which has at least three connection ports lying on a horizontal plane, with a row of at least two terminals at each port, which has simple and rugged means for connecting corresponding terminals at each port. The connector includes at least two sheet metal multi conductors, with each multi conductor having a least three ends that each forms one of the terminals at each port. Each multi conductor has a plate-like middle lying in a horizontal plane that is spaced from the row plane of the row of terminals, and has ends with inclined parts that extend from the plane of the middle to the row plane so each end connects the middle to a terminal. Two multi conductors for connecting first and second terminals at each port, are identical in construction but are oriented upside-down from each other.

The novel features of the invention are set forth with particularity in the appended claims. The invention will be best understood from the following description when read in conjunction with the accompanying drawings.

BRIEF DESCRIPTION OF THE DRAWINGS

FIG. 6 is an isometric view showing the four multi conductors of the connector of FIG. 1, but without the insulative body or frame of the connector, and showing how the multi conductors are positioned prior to overmolding to form the frame.

FIG. 7 is a plan view of one of the multi conductors of FIG. 6.

FIG. 8 is a view taken on line 8—8 of FIG. 7.

FIG. 9 is a view taken on line 9—9 of FIG. 7.

FIG. 13 is an isometric view of a conductor with three connection ports, constructed in accordance with another embodiment of the invention, wherein the ports are arranged in a T configuration.

FIG. 14 is an isometric view of one of the multi conductors of the connector of FIG. 13.

FIG. 15 is a plan view of the multi conductor of FIG. 14.

FIG. 16 is a view taken on line 16—16 of FIG. 15.

FIG. 17 is a view taken on line 17—17 of FIG. 15.

DESCRIPTION OF THE PREFERRED EMBODIMENTS

Figure 1:
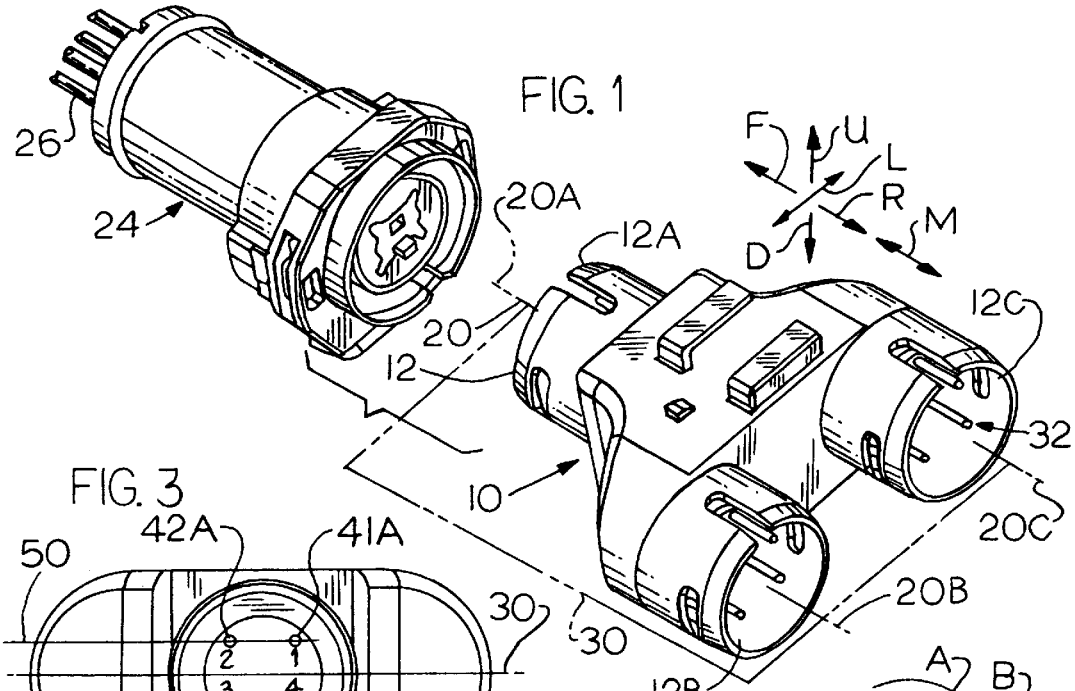
FIG. 1 is an exploded isometric view showing a connector of the present invention that has three connection ports, and a mateable connector device of the prior art that can mate with any of the three connection ports.

FIG. 1 illustrates a connector 10 of the present invention which has three connection ports 12A, 12B, and 12C that face along corresponding port axes 20A, 20B, and 20C. A mating connector device 24 from which wires 26 extend, can connect to any one of the three ports 12. The connection end of the device 24 is of the type shown in U.S. Pat. No. 5,639,255 (except that a locking spring is not shown in FIG. 1).

Figure 3:
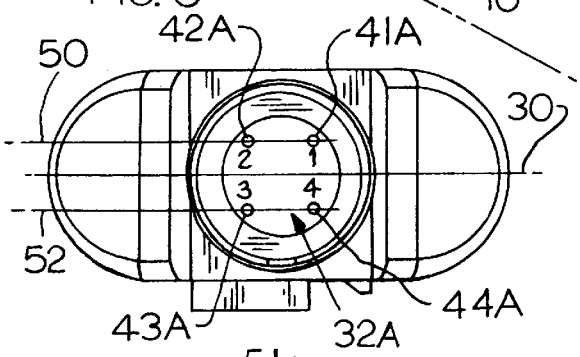
FIG. 3 is a front elevation view of the connector of FIG. 2.
Figure 4:
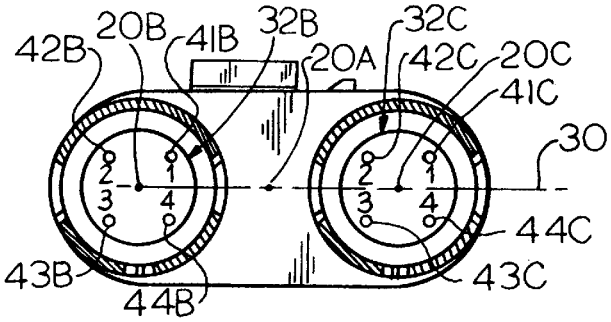
FIG. 4 is a rear elevation view of the connector of FIG. 2.

As shown in FIG. 4, all of the port axes 20 lie on a single port plane 30 which is illustrated as extending horizontally. There is a corresponding set of terminals 32, labeled 32A, 32B, and 32C at the three ports with each set including four terminals 41–44. The numeral for the terminals at each port is followed by a corresponding letter A, B, C. The four terminals at each port are arranged in two rows that lie in first and second row planes 50, 52 (FIG. 3). The two row planes are parallel to the port plane 30, and all are shown as being horizontal.

A multi conductor is required to connect all three first or primal terminals 41A, 41B, 41C at the three ports. Similarly, a multi conductor is required to connect all three second or next terminals 42A, 42B, 42C at the three ports. The fact that the primal and next terminals 41, 42 lie on the same horizontal plane 50, results in the possibility of the multi conductors for the two pluralities of terminals contacting each other, which would be unacceptable. It is desirable that any multi conductor be constructed of sheet metal, to enable low cost mass production of a rugged multi conductor.

Figure 1A:
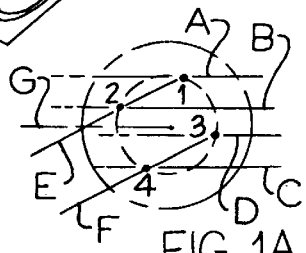
FIG. 1A is a diagrammatic view of another embodiment of the invention.
Figure 2:
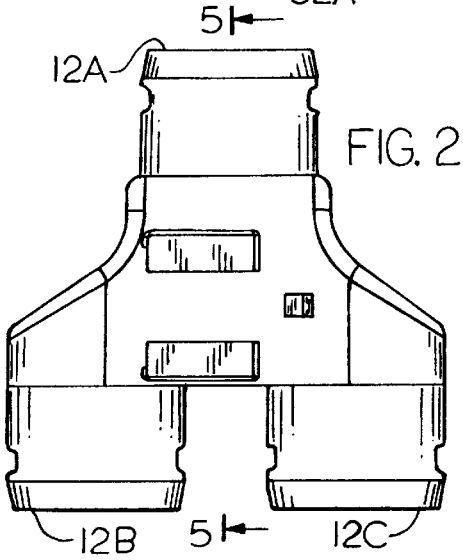
FIG. 2 is a plan view of the connector of FIG. 1.

FIG. 1A shows a solution to the problem of connecting each group of contacts that lies at three or more different ports. In FIG. 1A, the terminals 1, 2, 3, and 4 lie in rows E, F, that are angled from the horizontal plane G of the axes of all ports. As a result of the angling of the row planes E, F, four multi conductors A, B, C, D can be used that each lies on a single horizontal plane. However, customers usually desire to have at least one horizontal row of two conductors at each port, for appearance sake and to avoid cable twist, as shown in Applicant's FIGS. 3 and 4. The horizontal conductors shown in FIG. 1A at A, B, C, D could not be used for this purpose.

FIG. 6 shows four multi conductors 51–54 that each forms and connects one of the set of terminals at each of the three ports. Of the pair 51, 52, the first 51 can be referred to as the primal multi conductor, as it forms the first or primal terminals 41A, 41B, 41C at the three ports. The second multi conductor 52 can be referred to as the next multi conductor inasmuch as it forms and connects the second or next terminals 42A, 42B, 42C lying at the three ports. Each multi conductor includes three terminals, such as 41 lying in a row plane 50, a plate-like or planar middle 60 lying in an offset plane that is offset from the row plane 50, and ends 62A, 62B, and 62C that each have an inclined part 64 that extends from the row plane 50 to the offset plane. FIG. 9 shows the spacing J between the row plane 50 and the first or upper offset plane 66.

Figure 11:
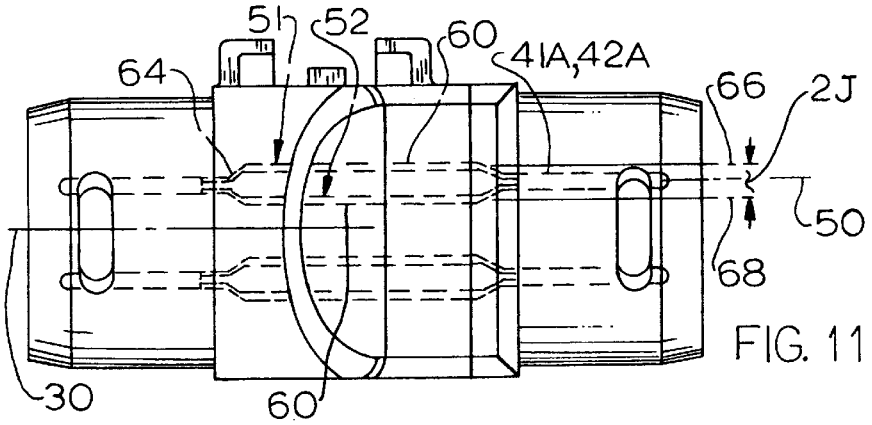
FIG. 11 is a side elevation view of the connector of FIG. 10, and showing, in hidden lines, the multi conductors.
Figure 10:
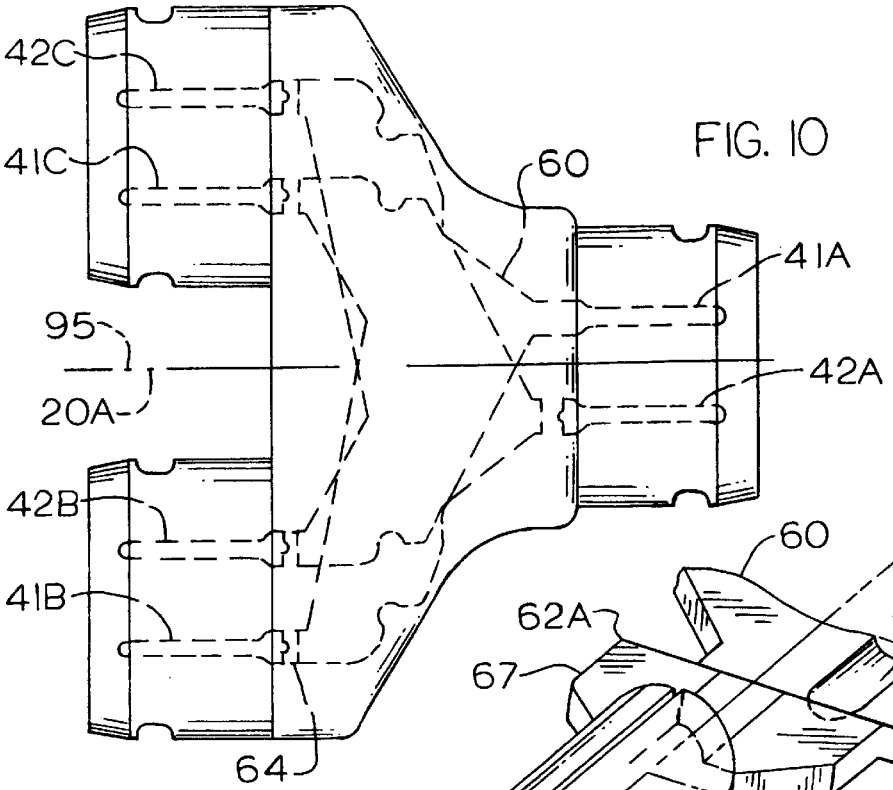
FIG. 10 is a plan view similar that of FIG. 2, but without the mounting brackets, and showing, in hidden lines, the multi conductors.

Applicant forms all of the multi conductors 51–54 (FIG. 6) identically. However, the two next multi conductors 52, 54 are oriented 180°, or upside-down from the orientation of the primal multi conductors 51, 53. As shown in FIG. 11, this results in the middles 60 of the two multi conductors 51, 52 each being offset by the distance J from the row plane 50, but with the middle of the primal multi conductor 51 being upwardly offset and the other being downwardly offset for a spacing 2J between the upper and lower offset planes 66, 68.

Figure 12:
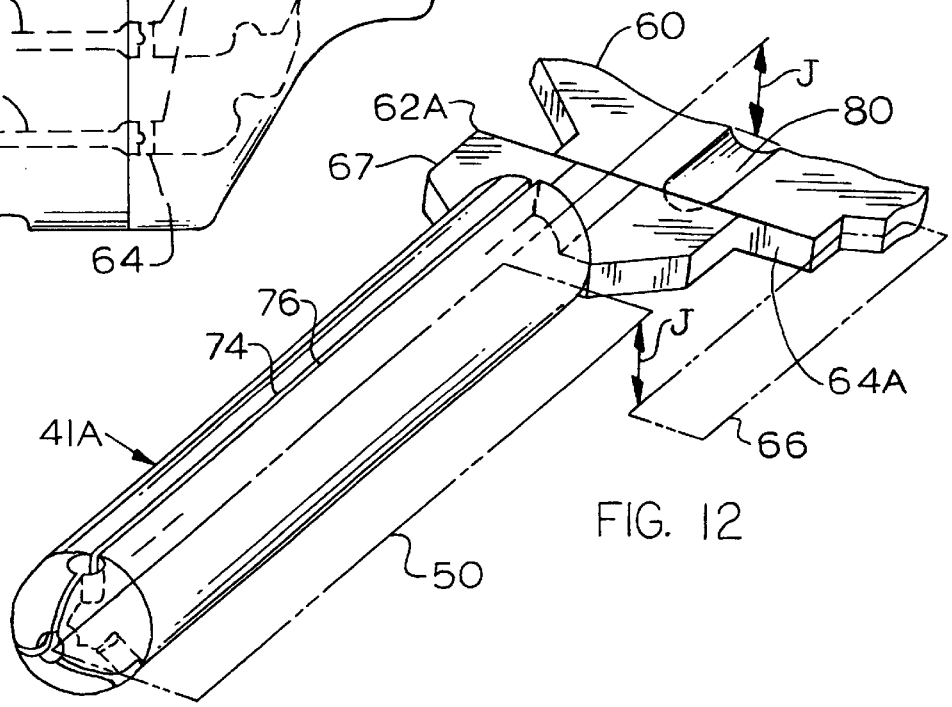
FIG. 12 is an enlarged isometric view of a portion of one of the multi conductors of FIG. 6, showing the area 12—12 of FIG. 6.

Each of the four multi conductors, such as 51 in FIG. 7, is formed from a piece of sheet metal, with FIG. 7 showing links 70 that connect each piece of sheet metal that is to form a multi conductor to adjacent pieces of sheet metal that are to form other identical multi conductors. Each portion 72 which is to form a terminal, is bent by substantially 360° (between 330° and 360°) to form a pin terminal. FIG. 12 shows how the opposite edges 74, 76 of the terminal is bent. The middle 60 of the multi conductor is maintained primarily or substantially flat, except that it forms elongated bent parts or channels 80 that are concave on one face of the middle and convex on the upper face, to strengthen the middle. The channels initially extend parallel to the corresponding pin terminal such as 41A, although the channel then extends at an angle so, as shown in FIG. 7, the three channels 80A, 80B, 80C merge. The multi conductor has three ends 82A, 82B, 82C, with each end having an inclined end part 64A, 64B, 64C. As shown in FIG. 12 each inclined part, such as 64A, extends from an offset plane such as 66 to the row plane 50. Each end includes a transition part 67 that extends from the pin to the inclined part, with the inclined and transition parts preferably being in the form of a strip.

As shown in FIG. 9, applicant prefers an incline angle K from the horizontal of about 30°, with the angle being between 10° and 90°.

Figure 5:
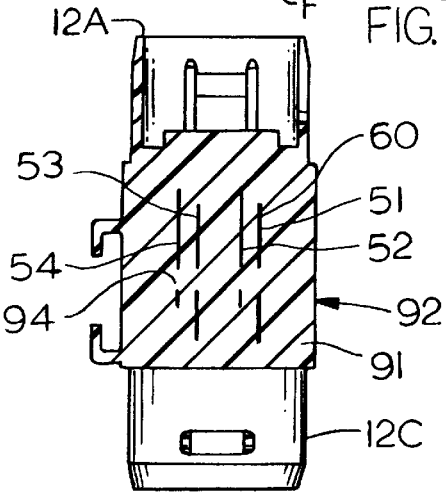
FIG. 5 is a sectional view taken on line 5—5 of FIG. 2.

To form the connector, four multi conductors are positioned as shown in FIG. 6 in a mold, with each multi conductor being held by its terminals. A quantity 91 of insulative, or dielectric material, is injection molded into the mold cavity to form the body or frame of the connector. FIG. 5 shows the molded frame 92 and the middles 60 of the four multi conductors 51–55. It may be noted that each multi conductor has a hole 94 therein which aids in handling the multi conductor. As shown in FIG. 7, the hole 94 lies on the axis 20A of the first port and on a vertical plane of symmetry 95 of the connector. When a multi conductor is turned upside-down, it is also shifted by a distance P equal to the pitch or center-to-center spacing between terminals such as 41A, 42A of a row. Each port can have a key, where desired.

FIG. 13 illustrates another connector 100 with three ports 102A, 102B, 102C that have corresponding axes 104A, 104B, 104C, with two of the axes being aligned and the other being perpendicular to the other two. All three axes lie on a common port plane 106. Each port has four terminals 111–114 arranged in two horizontal rows, and are identical to the arrangements shown in FIGS. 3 and 4. FIG. 14 shows a multi conductor 120 that is used in the connector of FIG. 13 with four of such multi conductors being used and with two being upside-down from the orientation of two others, in the same manner as for the connector of FIGS. 1–12. The multi conductor has a middle 122 lying in a plane that is offset from a plane that contains the terminals 111A, 111B, 111C. Three ends 124 of the multi conductor that connect the middle 122 to each of the terminals, includes an incline part 126.

In a connector that applicant has designed, of the construction shown in FIGS. 1–12, the pitch P (FIG. 7) between terminals is 0.230 inch (5.84 mm) with a vertical distance between upper and lower row planes 50, 52 (FIG. 3) being 0.230 inch (5.84 mm). Each multi conductor such as 51 (FIG. 7) is constructed of copper alloy having a thickness of 0.010 inch. The offset J between a row plane 50 and an offset plane 66 was 0.30 inch (0.76 mm). Each channel resulted in the overall thickness Q of the middle, including the channel, being 0.020 inch (0.51 mm) although applicant considers the plane of the middle to be the plane of the plate-like part without the channels (halfway between the opposite faces). Each of the terminals had an outside diameter of 0.40 inch (1.02 mm). The horizontal distance between the second and third axes 20B, 20C was 1.050 inch (26.67 mm).

While terms such as "horizontal" have been used in describing the invention as illustrated, it should be understood that the connector can be used in any orientation with respect to the Earth.

Thus, the invention provides a connector having at least three connection ports with axes lying on a common horizontal port plane, with a geometrically identical arrangement of terminals at each port, and with a horizontal row of terminals at each port, which has a multi conductor of simple, low cost, and rugged construction. Each multi conductor is formed of sheet metal with at least three ends forming the three terminals lying on a common row plane, and having a middle lying on an offset plane that is vertically offset from the row plane. The multi conductor also has three ends that join the middle to each terminal, with each end having a part extending at an incline of a plurality of degrees from the horizontal from one plane to the other. For each pair of terminals that lie in a single row at each port, two identical multi conductors are used, but are turned upside-down from one another, so the middle of one multi conductor lies above the row plane while the middle of the other multi conductor lies below the row plane. Where a third terminal is provided to lie in each row, its multi conductor can have a middle that lies in the row plane. The middle of each multi conductor preferably has channels that strengthen it, with the channels extending from the ends and merging.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector having at least three connection ports (12) that each opens along a corresponding port axis (20) that extends through the center of the port, with said axes all lying on a single port plane (30), said connector having a set (32) of terminals at each port with each set having the same geometric arrangement at each port, and with each terminal that lies in a particular geometric location at a port being part of a multi conductor (51–54) that forms and connects to a corresponding terminal at each of the other of said ports, wherein the set of terminals at each port includes at least a first pair of terminals (41, 42) that are electrically isolated from each other and that lie substantially in a row plane (50) that is parallel to said port plane (30), wherein:

a first, or primal, one of said multi conductors (51) comprises a piece of sheet metal that has at least three ends with each end having an inclined end part (64) extending at an incline to said row plane and with each end connected to one of the terminals of each of said first pairs that lies at each of said ports, and said primal multi conductor has a middle (60) that connects together said ends of said first multi conductor;

the middle of said first multi conductor lying primarily in an offset plane (66) that is spaced from said row plane (50).

2. The connector described in claim 1 wherein:

said connector has a vertical plane of symmetry (95) with at least one pair of said ports (12B, 12C) lying on opposite sides at said plane of symmetry;

a second (52) of said multi conductors is identical to said first multi conductor but is oriented upside-down from the orientation of said first multi-conductor and its terminals are horizontally shifted in said row plane by the distance (P) between the centers of the terminals of said pair.

3. A connector having three connection ports (12A, 12B, 12C) that have corresponding port axes (20A, 20B, 20C) that all lie in a single horizontal port plane (30), said connector having a set of terminals at each of said ports with each set of terminals having the same geometric arrangement with respect to its corresponding port axis, wherein each set of terminals includes a pair of electrically isolated horizontally-spaced terminals (41, 42) comprising primal and next terminals lying in a horizontal row plane (50) wherein:

said connector includes primal and next multi conductors (51, 52) that are each formed of sheet metal, with said primal multi conductor forming three of said primal terminals (41A, 41B, 41C) wherein said primal terminals all lie in said horizontal row plane (50), said primal multi conductor includes a plate-like middle (60) lying in a horizontal upper offset plane (66) that is vertically spaced from said row plane to lie above said row plane, and said primal multi conductor includes ends (62A, 62B, 62C) with inclined parts (64) that extend at a plurality of degrees from the vertical, from said upper offset plane (66) to said row plane (50) and with each of said ends merging with one of said primal terminals (41A, 41B, 41C).

4. The connector described in claim 3 wherein:

said next multi conductor (52) is identical to said primal multi conductor, but said next multi conductor is oriented upside down and with its terminals (42A, 42B, 42C) shifted in a first direction horizontally from corresponding primal terminals (41A, 41B, 41C) by a center-to-center horizontal distance (P) between said primal and next terminals of a set.

5. The connector described in claim 3 wherein:

said three connector ports are arranged with a first port (12A) facing in a longitudinal forward direction (F) along a first of said port axes (20A) and second and third ports (12B, 12C) each facing in a rearward longitudinal direction (R) along second and third of said port axes (20B, 20C), with said first axis (20A) lying laterally halfway between said second and third axes.

6. The connector described in claim 3 wherein:

said three connector ports are arranged with a first port (102A) facing in a longitudinal forward direction (F) along a first of said port axes (104A) and second and third ports (102B, 102C) facing in opposite lateral directions which are perpendicular to said longitudinal direction, with said port axes intersecting.

7. Apparatus for use in a connector that has at least three connection ports that each opens along a corresponding port axis (20A, 20B, 20C) that extends through the center of the port, with said axes all lying in a single horizontal port plane (30), where said connector includes at least two horizontally spaced terminals at each port including a primal terminal (41) and a next terminal (42) both lying on a horizontal row plane (66) and electrically isolated from each other, including a primal multi conductor (51) that forms and connects all of said primal terminals, wherein:

said primal multi conductor includes a piece of sheet metal forming at least three of said terminals where said sheet metal has been wrapped approximately 360° to form a pin that forms one of said primal terminals, wherein said multi conductor forms a plate-like middle (60) that lies primarily in a horizontal offset plane (66) that is vertically spaced from said row plane, and wherein said multi conductor forms at least three ends that connect said middle to each of said terminals, with each end having an inclined part (64) that extends by a plurality of degrees from the horizontal between said offset plane and said row plane.

8. The apparatus described in claim 7 wherein:

each of said ends is in the form of a strip that extends parallel to a corresponding pin and that forms said inclined part and that forms a transition part (67) between the corresponding pin and said inclined part.

9. The apparatus described in claim 7 wherein:

said middle is formed with three channels (80A, 80B, 80C) that each initially extends from one of said ends and parallel to the corresponding pin, with said channels merging.

10. The apparatus described in claim 7 including:

a next multi conductor (52) that forms and connects all of said next terminals (42A, 42B, 42C), with said next multi conductor being identical to said primal multi conductor but lying upside-down from the orientation of said primal multi conductor;

a quantity (91) of polymer material forming a connector frame (92) including said at least three ports, with said middles and ends of said primal and next multi conductors molded in place in said frame.

* * * * *